US007179002B2

(12) United States Patent
Lee et al.

(10) Patent No.: US 7,179,002 B2
(45) Date of Patent: Feb. 20, 2007

(54) THERMAL IMAGE FORMING APPARATUS

(75) Inventors: Young-duk Lee, Gunpo-si (KR); Heon-soo Park, Seongnam-si (KR); Jong-sung Jung, Suwon-si (KR); Dong-Hun Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 123 days.

(21) Appl. No.: 11/007,463

(22) Filed: Dec. 9, 2004

(65) Prior Publication Data

US 2005/0140771 A1 Jun. 30, 2005

(30) Foreign Application Priority Data

Dec. 31, 2003 (KR) ..... 10-2003-0101583
Jun. 10, 2004 (KR) ..... 10-2004-0042504

(51) Int. Cl.
*B41J 3/60* (2006.01)
*B41J 25/00* (2006.01)
*B41J 3/32* (2006.01)

(52) U.S. Cl. ..... 400/120.17; 400/188; 400/120.16

(58) Field of Classification Search ..... 400/188
See application file for complete search history.

(56) References Cited

U.S. PATENT DOCUMENTS 4,170,422 A * 10/1979 Bilek ..... 400/120.16
4,561,352 A 12/1985 Svyatsky et al.
5,330,274 A 7/1994 Schimmelpfennig et al.
5,675,369 A * 10/1997 Gaskill ..... 347/171
6,296,405 B1 10/2001 Brewington et al.
2002/0001027 A1 1/2002 Sugioka et al.
2006/0103715 A1* 5/2006 Haimberger et al. ..... 347/197

FOREIGN PATENT DOCUMENTS

| | | | |
|---|---|---|---|
| EP | 0636951 | | 7/1994 |
| JP | 61-152468 | | 7/1986 |
| JP | 03153379 | A * | 7/1991 |
| JP | 05-238073 | | 9/1993 |
| JP | 05-338274 | | 12/1993 |
| JP | 09-086007 | | 3/1997 |
| JP | 10-076713 | | 3/1998 |
| JP | 2001-260515 | | 9/2001 |
| JP | 2001-310503 | | 11/2001 |
| JP | 2003-080688 | | 3/2003 |

* cited by examiner

*Primary Examiner*—Daniel J. Colilla
(74) *Attorney, Agent, or Firm*—Roylance, Abrams, Berdo & Goodman, L.L.P.

(57) ABSTRACT

A thermal image forming apparatus is provided adapted to form images on both sides of a recording medium. The thermal image forming apparatus includes an image forming part having a recording head for forming an image on the recording medium and a support member facing the recording head and supporting the recording medium with respect to the recording head. The recording medium has a first side and a second side opposite to the first side. A position changing unit rotates the recording head around a shaft of the support member to move the recording head to first and second locations respectively facing the first and second sides of the recording medium.

15 Claims, 13 Drawing Sheets

THERMAL IMAGE FORMING APPARATUS

CROSS REFERENCE TO RELATED APPLICATION

This application claims the benefit under 35 U.S.C. § 119(a) of Korean Patent Application No. 2003-101583, filed on Dec. 31, 2003, and No. 2004-42504, filed on Jun. 10, 2004, in the Korean Intellectual Property Office, the entire disclosures of both applications being hereby expressly incorporated by reference.

BACKGROUND OF THE INVENTION

1. Field of the Invention

The present invention relates to an image forming apparatus. More particularly, the present invention relates to a thermal image forming apparatus adapted to form an image on both sides of a recording medium.

2. Description of the Related Art

To print an image on both sides of a recording medium, two recording heads may be provided at positions facing both sides of the recording medium. In this case, however, such an image forming apparatus is expensive.

In an alternative method, one recording head is provided and the recording head is designed to face the first and second sides of the recording medium in turn. In this case, two approaches may be considered. A first approach is to fix the recording head and invert the recording medium. A second approach is to move the recording head to positions facing the first and second sides of the recording medium.

U.S. Pat. No. 6,296,405 discloses an image forming apparatus configured based on the first and second approaches. In this patent, a recording head is installed in a rotational bracket and the rotational bracket is reciprocated between first and second positions around a pivot shaft. The first side is printed while the recording medium passes through the first position, and the second side is printed while the recording medium moves from the first position to the second position.

U.S. Pat. No. 6,601,952 discloses an image forming apparatus employing the second approach. In this patent, a support member for pressing a recording medium toward a recording head and a holding means for holding the recording medium are constructed as one rotation unit. The rotation unit is rotated to allow the recording head to face first and second sides of the recording medium.

SUMMARY OF THE INVENTION

The present invention provides a thermal image forming apparatus adapted to perform double-sided printing, which has structure that is simple and small in size.

According to another aspect of the present invention, a thermal image forming apparatus has an image forming part that includes a recording head for forming an image on a recording medium and a support member facing the recording head and supporting the recording medium with respect to the recording head. The recording medium has a first side and a second side opposite the first side. A position changing unit rotates the recording head around a shaft of the support member to move the recording head to first and second locations respectively facing the first and second sides of the recording medium.

According to another embodiment of the present invention, the position changing unit of the thermal image forming apparatus may include a support bracket rotatably supported on a shaft of the support member and to which the recording head is coupled. A rotation cam rotates the support bracket to to selectively face the recording head to the first and second sides of the recording medium. The thermal image forming apparatus may further include a shaft having one end connected to the recording head and the other end inserted into a through hole formed in the support bracket. The rotation cam pushes the support bracket to be rotated.

Another embodiment of the thermal image forming apparatus may also include a locking unit for locking the recording head at the first and second locations. The locking unit may include first and second locking grooves formed at the support bracket The first and second locking grooves correspond to the first and second locations of the recording head. A locking member selectively locks into the first and second locking grooves. An elastic member elastically biases the locking member toward the first and second locking grooves. The rotation cam releases the locking member from the first and second locking grooves and rotates the support bracket.

The thermal image forming apparatus of another embodiment may further include an elastic member to elastically bias the recording head toward the support member. The recording head is rotatably installed in the support bracket in a direction that comes into contact with the support member or in a direction that is separated from the support member.

The thermal image forming apparatus of another embodiment may further include a conveying part for conveying the recording medium in a first direction to form an image or in a second direction to set a start location. The support member is driven and rotated by contact with the recording medium while the recording medium is conveyed in the first direction.

Another embodiment of the thermal image forming apparatus may further include a first path through which the recording media is initially fed, a second path installed in the image forming part, and a third path branched from a connecting part of the first and second paths and through which a printed recording medium is discharged. A conveying part is installed in the connecting part to convey the recording medium in the first or second direction. In this case, the thermal image forming apparatus may further include a recording medium guide rotating to a third location to guide the recording medium from the first path to the second path, and to a fourth location for guiding the recording medium from the second path to the third path and from the third path to the second path. The thermal image forming apparatus of this embodiment may further comprise an elastic member to apply an elastic force to the recording medium guide to rotate the recording medium guide to the fourth location. The recording medium moves from the first path to the second path, and the recording medium guide comes into contact with the recording medium and rotates toward the third location.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings in which.

Throughout the drawing like reference numbers are used to depict like features, elements and structures.

DETAILED DESCRIPTION OF EXEMPLARY EMBODIMENTS

Exemplary embodiments of the present invention will now be described more fully with reference to the accompanying drawings.

In order to fully understand an overall structure of an image forming apparatus according to exemplary embodiments of the present invention, a recording medium conveying structure and a recording head position changing structure will now be described.

Figure 1:
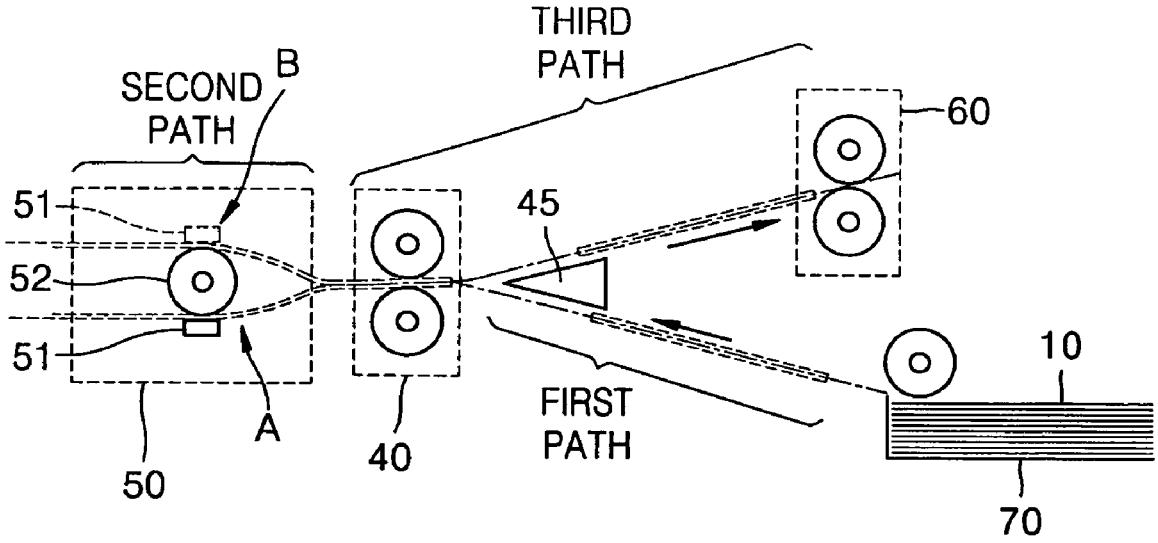
FIG. 1 is a schematic view illustrating a thermal image forming apparatus according to an embodiment of the present invention.

FIG. 1 is a schematic view of an image forming apparatus according to an embodiment of the present invention. Referring to FIG. 1, an image forming apparatus includes a first path, a second path and a third path, through which a recording medium 10 is conveyed. The first path is a feed path through which the recording medium 10 is conveyed toward the second path. The second path is a path through which printing is performed on the recording medium 10. The third path is a path through which the recording medium 10 is discharged during the printing or when an image is completely printed on first and second sides of the recording medium.

A recording medium guide 45 is disposed between the first path and the third path. The recording medium guide 45 guides the recording medium fed through the first path toward the second path and also guides the recording medium 10 from the second path to the third path during the printing. A conveying part 40 conveys the recording medium 10 from the first path to the second path, from the second path to the third path, from the third path to the second path, and from the second path to the third path in this order.

Figure 6:
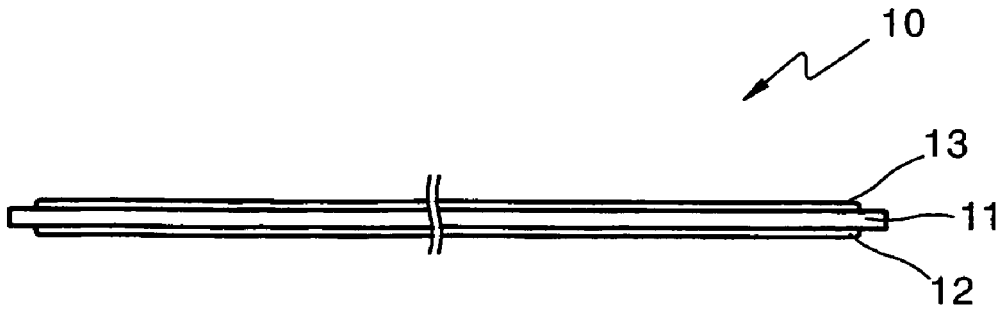
FIG. 6 is a sectional view of a recording medium according to an embodiment of the present invention.

Preferably, recording medium 10 used in the image forming apparatus may have a structure as shown in FIG. 6. The recording medium 10 includes a base sheet 11 having first and second sides, and color ink layers 12 and 13 formed on the first and second sides. Each of the ink layers 12 and 13 may have a single-layer structure for single color or a multi-layer structure for two or more colors. For example, the ink layer 12 formed on the first side may be provided with two stacked layers for yellow and magenta, and the ink layer 13 formed on the second side may be provided with a single layer for cyan.

The image forming apparatus according to the present invention uses the recording medium 10 that produces color images provided by the image formation with respect to the first and second sides. The technical scope of the present invention is not limited to the above-described ink structures formed on the first and second sides of the recording medium 10. An embodiment of the present invention provides a thermal image forming apparatus and a recording head 51 including a thermal print head (TPH).

An image forming part 50 with a support member 52 facing the recording head 51 is disposed on the second path. When the printing is performed on the first side of the recording medium 10, the recording head 51 is positioned at a location "A". When the printing is performed on the second side of the recording medium 10, the recording medium 51 is positioned at a location "B". The position of the recording head 51 is changed when the recording medium 10 is not positioned at the second path, for example, before the recording medium 10 is fed from the first path, or when the recording medium 10 is conveyed to the third path after the printing on the first side but before returning to the second path.

The recording medium 10 is picked up from a cassette 70 and fed to the second path via the first path. The recording head 51 is positioned at the location "A". The conveying part 40 conveys the recording medium in a second direction, so that the recording medium is positioned at a predetermined print start location. Then, the conveying part 40 conveys the recording medium 10 in a first direction. The recording medium 10 is conveyed from the second path to the third path. During that time, the printing is performed on the first side of the recording medium 10. After finishing the printing on the first side, the recording head 51 rotates to the location "B". The conveying part 40 conveys the recording medium 10 in the second direction. The recording medium 10 is conveyed from the third path to the second path. When the recording medium 10 is positioned at the print start location, the conveying part 40 again conveys the recording medium 10 in the first direction. The recording medium 10 is again conveyed from the second path to the third path. During that time, the printing is performed on the second side of the recording medium 10. After finishing the printing on the second side, the discharge part 60 discharges the recording medium 10 out of the image forming apparatus.

Figure 2:
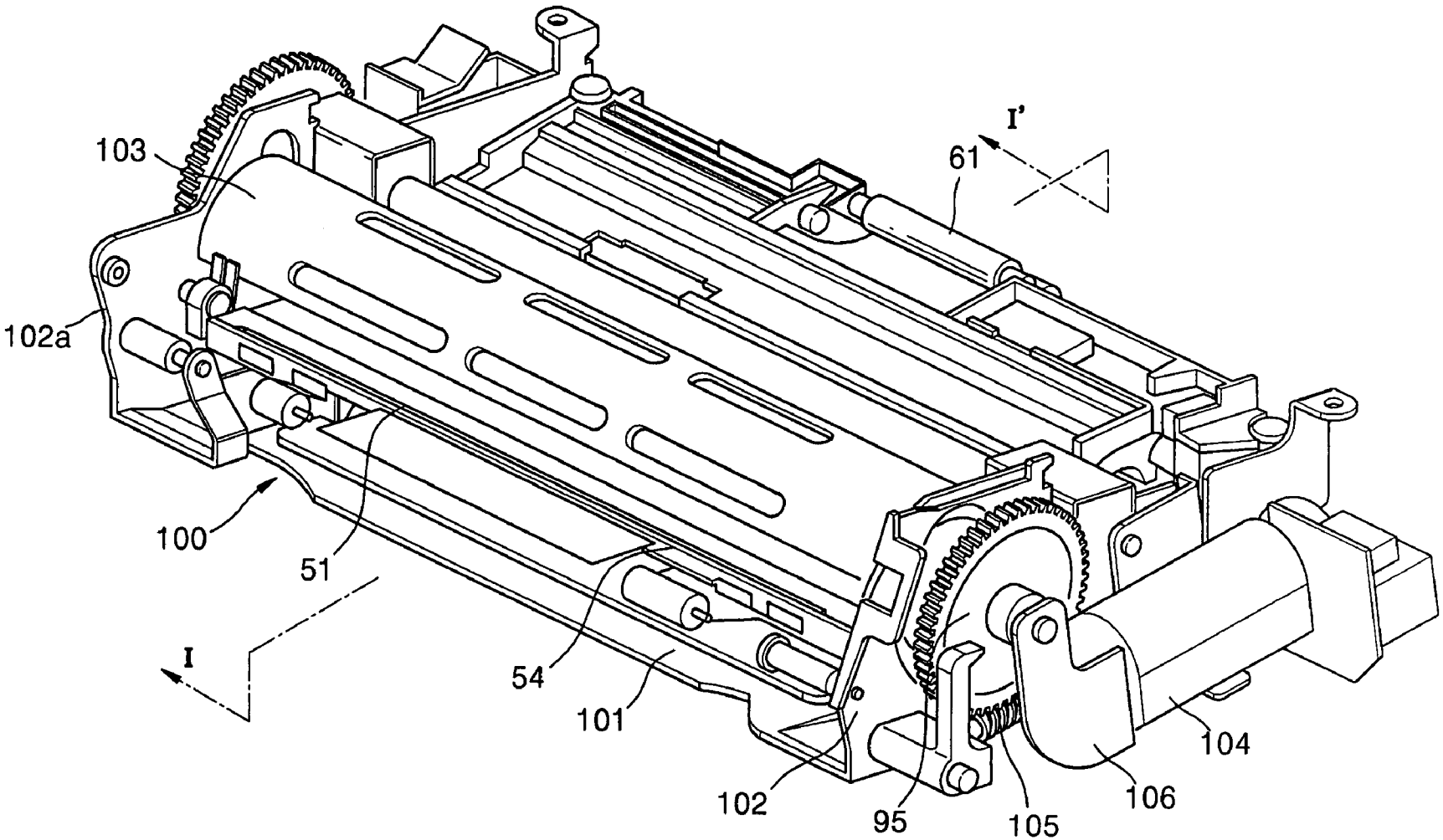
FIG. 2 is a perspective view of a thermal image forming apparatus according to an embodiment of the present invention.
Figure 3:
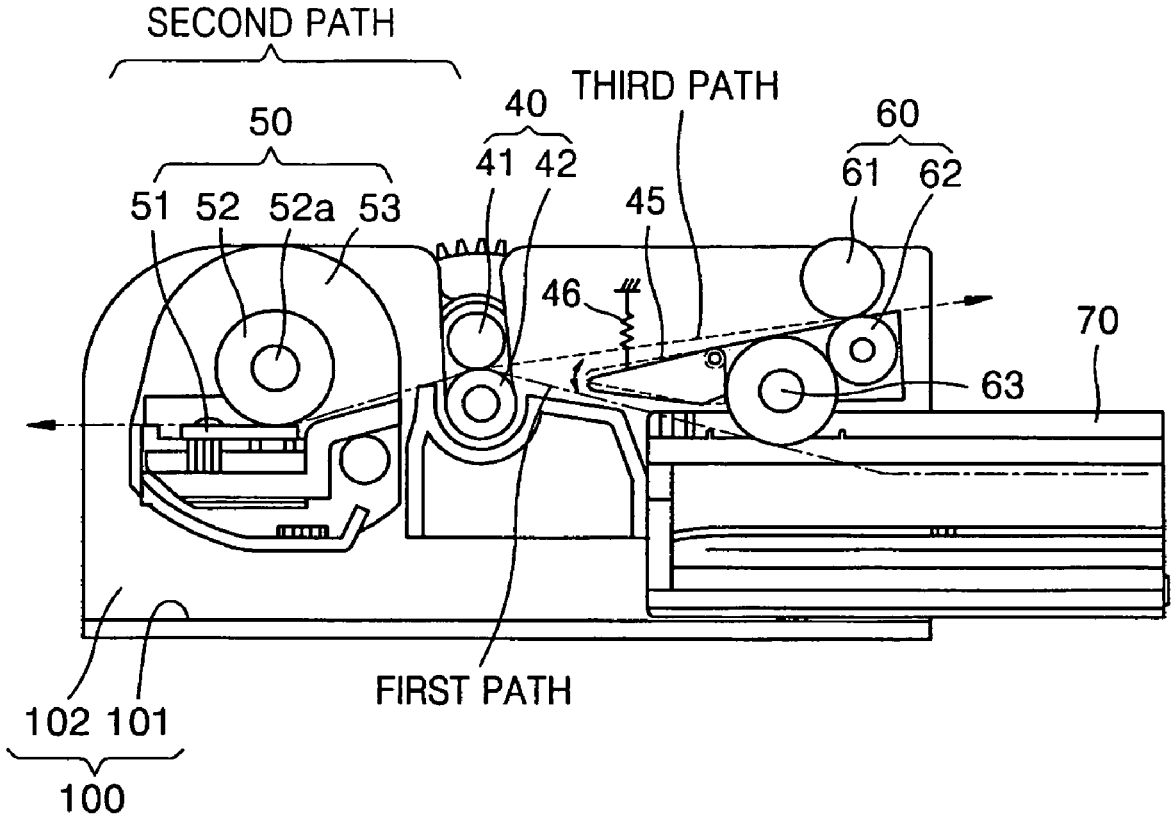
FIG. 3 is a sectional view taken along the line I–I' of FIG. 2.

FIG. 2 is a schematic perspective view of the thermal image forming apparatus according to an embodiment of the present invention, and FIG. 3 is a sectional view taken along the line I–I' of FIG. 2.

Referring to FIGS. 2 and 3, a frame 100 includes a lower base 101 and two side plates 102 and 102*a* disposed upright on both sides of the lower base 101. The cassette 70 into which the recording medium 10 is loaded is mounted on one side of the frame 100. A pickup roller 63 disposed proximal an upper side of the cassette 70 picks up the recording medium 10 from the cassette 70. The discharge part 60 is disposed above the cassette to discharge the printed recording medium. The discharge part 60 includes a discharge roller 62 and an idle roller 61 engaged therewith. In this embodiment, the pickup roller 63 and the discharge roller 62 are in contact with each other and are driven by one drive motor (not shown). The drive motor (not shown) may be coupled to the side plate 102*a*. The recording head 51 and the support member 52 are provided at a side opposite to the discharge part 60 between the two side plates 102 and 102*a*. For example, the support member 52 may be a platen roller, as shown in FIG. 2. The conveying part 40 conveys the recording medium 10 in the first direction for printing or in the second direction for setting up the print start location. The conveying part 40 includes a pair of rollers 41 and 42, which are elastically engaged with each other. A torque of the drive motor is transferred to only one of the rollers 41 and 42, and the other roller is driven.

As shown in FIG. 3, the above-described structure defines the first path from the cassette 70 to the conveying part 40, the second path from the conveying part 40 to the image forming part 50, and the third path from the conveying part 40 to the discharge part 60. The recording medium guide 45 separates the first path from the third path.

The recording medium guide 45 is rotatably installed, as shown in FIG. 3. The recording medium guide 45 rotates toward a third location (indicated by a dashed line in FIG. 3) for guiding the recording medium 10 from the first path to the second path, and to a fourth location (indicated by a solid line in FIG. 3) for guiding the recording medium 10 from the second path to the third path and from the third path to the second path. An elastic member 46 applies an elastic force to the recording medium guide 45 to rotate it to the fourth location. When the recording medium 10 moves from the first path to the second path, the recording medium 10 pushes the recording medium guide 45 in a direction opposite to the elastic force of the elastic member 46, such that the recording medium guide 45 rotates to the third location.

The image forming apparatus according to an embodiment of the present invention includes a position changing unit for rotating the recording head 51 around a shaft 52*a* of the support member 52 such that the recording head 51 moves to the first or second location respectively facing the first or second side of the recording medium 10. Also, the image forming apparatus according to an embodiment of the present invention includes a locking unit for locking the recording head 51 at the first or second location. In this embodiment, the recording head 51 rotates in a direction that comes into contact with the support member 52 or in a direction that is separated from the support member 52.

Figure 4:
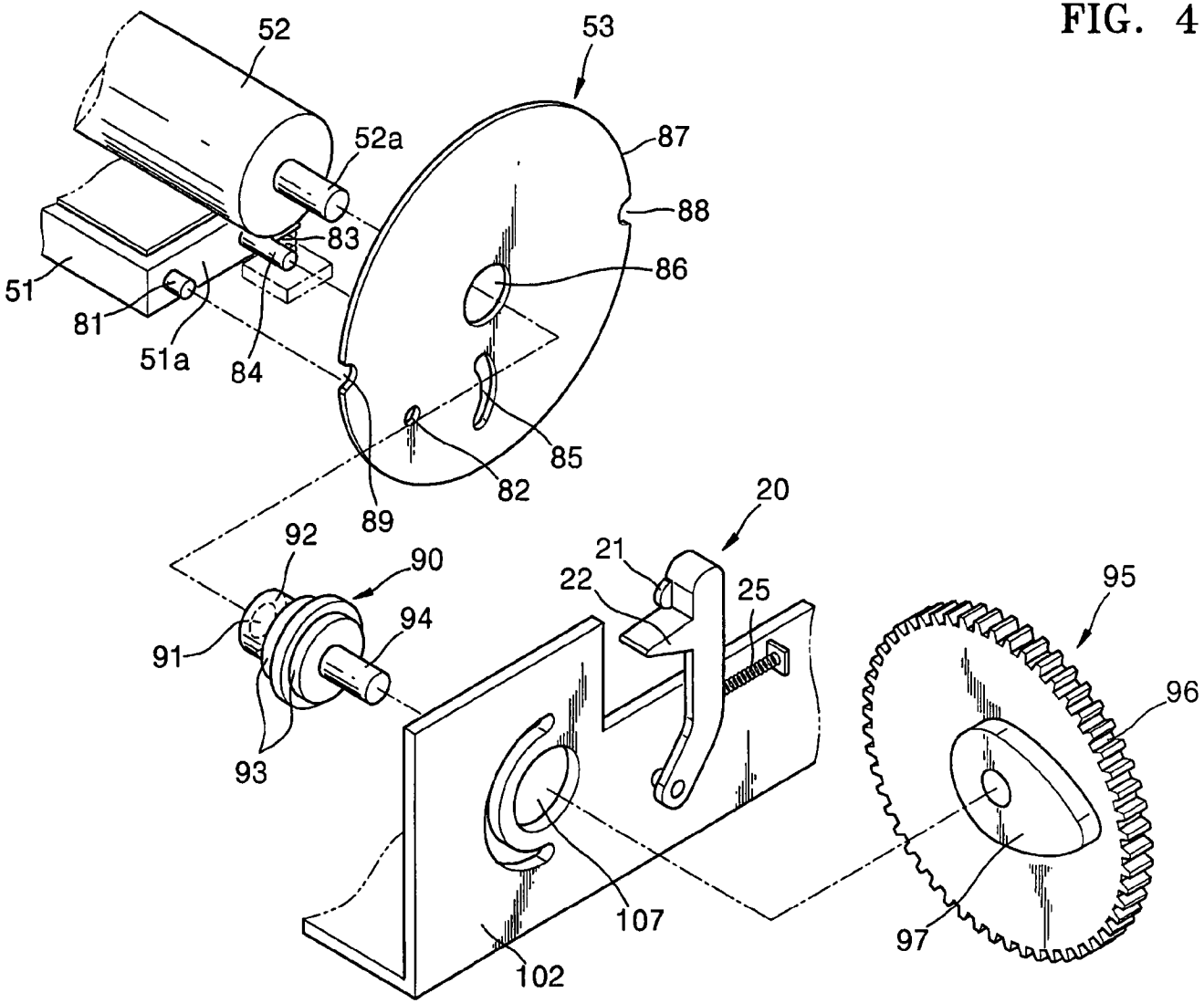
FIG. 4 is an exploded perspective view illustrating a position changing unit and a locking unit according to an embodiment of the present invention.

FIG. 4 is an exploded perspective view of the position changing unit and the locking unit according to an embodiment of the present invention.

Referring to FIG. 4, the position changing unit includes a support bracket 53 mounted rotatably around the shaft 52*a* of the support member 52, and a rotation cam 95 for rotating the support bracket 53. The recording head 51 is coupled to the support bracket 53. A hinge shaft 81 is provided at a side portion 51*a* of the recording head 51 and a hinge hole 82 is formed at the support bracket 53. The hinge shaft 81 is inserted into the hinge hole 82 such that the recording head 51 is rotatable around the hinge hole 82 of the support bracket 53. The elastic member 83 elastically biases the recording head 51 in a direction that comes into contact with the support member 52. Although not shown in detail, a tension coil spring having one end coupled to the recording head 51 and the other end coupled to a cover (103 in FIG. 2) enclosing the support member 52 may be used as the elastic member 83.

One end of the push arm 84 is coupled to the recording head 51 and the other end is inserted into a through hole 85 formed at the support bracket 53. Preferably, the through hole 85 is formed in a long opening shape to allow the recording head 51 to move in a direction coming into contact with the supporting member 52 or in a direction being separated from the supporting member 52. Also, preferably, the through hole 85 is formed in an arc shape aligned with the center of the hinge hole 82 because the recording head 51 comes into contact with the supporting member 52 and is separated from the support member 52 by its rotation around the hinge hole 82. In this embodiment, the support member 52 is not directly coupled to the drive motor (not shown). As the recording member 10 is fed by the conveying part 40, the support member 52 comes into contact with the recording medium 10, such that it is driven and rotated. Of course, the support member 52 may be directly connected to the drive motor (not shown).

A bushing 90 includes an inner circumference portion 91 and first to third outer circumference portions 92, 93 and 94, which are concentric. The shaft 52*a* of the support member 52 is inserted into the inner circumference portion 91. The first outer circumference portion 92 is rotatably inserted into a support hole 86 formed at the support bracket 53. The rotation cam 95 is rotatably coupled to the third outer circumference portion 94. The rotation cam 95 includes a gear 96 and a cam 97 that comes into contact with the push arm 84. A motor (104 in FIG. 2) includes a worm gear 105 engaged with the gear 96. The motor 104 is coupled to a bracket 106, which is coupled to the side plate 102. The second outer circumference portion 93 of the bushing 90 is inserted into a hole 107 formed at the side plate 102, and an end portion of the third outer circumference portion 94 is supported by the bracket 106. The bracket 106 prevents the rotation cam 95 from being released from the third outer circumference portion 94. Due to this structure, the support member 52, the support bracket 53, and the rotation cam may be concentrically configured.

The support bracket 53 has a circular outer circumference 87. The locking unit includes first and second locking grooves 88 and 89 formed on the outer circumference 87 of the support bracket 53. Preferably, locking grooves 88 and 89 are diametrically opposed on the outer circumference 87 of the support bracket 53 or separated by substantially 180°. A locking member 20 has an interference portion 22 that interferes with the cam 97 of the rotation cam 95 and a protrusion 21 adapted to be coupled to the first and second locking grooves 88 and 89. The locking member 20 is rotatably coupled to the side plate 102. An elastic member 25 applies an elastic force to the locking member 20 in a direction coupling the protrusion 21 to one of the first and second locking grooves 88 and 89. In one embodiment, the locking member 20 is unlocked from one of the first and second locking grooves 88 and 89 by the rotation cam 95, and it is locked thereto by the elastic force of the elastic member 25. Although not illustrated in the drawings, the support bracket 53, which supports the recording head 51 and the support member 52, is also installed on the side plate 102. In addition, the side plate 102 may have the rotation structure of FIG. 4.

FIGS. 5A through 5I are sectional views illustrating a rotating operation of the recording head 51, and FIGS. 7A through 7H are sectional views illustrating a printing operation of the thermal image forming apparatus according to an embodiment of the present invention. The printing operation of the thermal image forming apparatus according to the present invention is described in the following paragraphs with reference to FIGS. 1 through 4, FIGS. 5A through 5I, and FIGS. 7A through 7H.

Figure 5A:
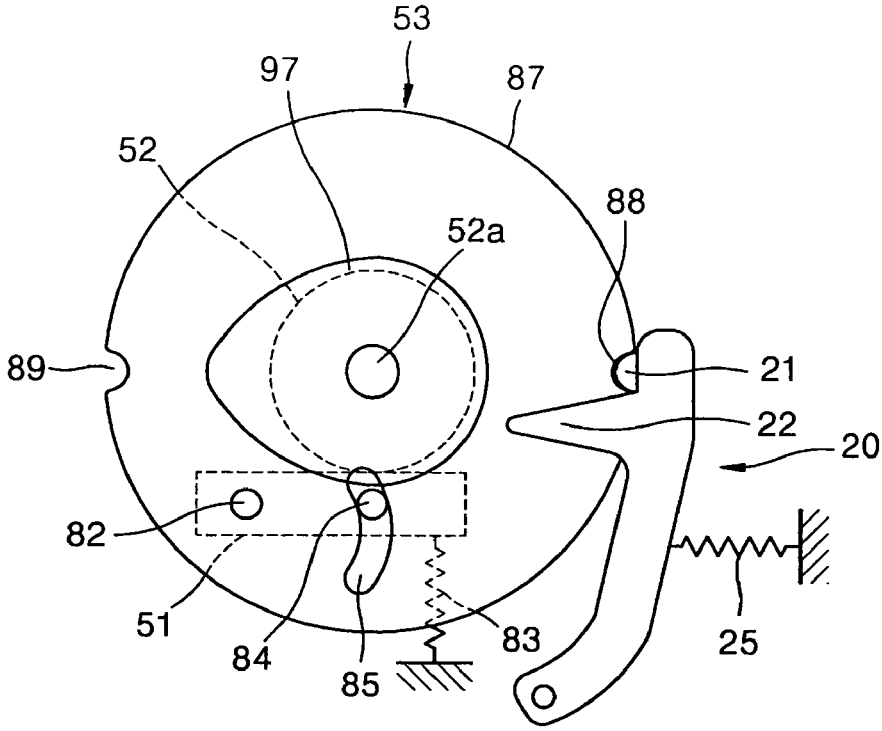
FIGS. 5A through 5I are views illustrating an operation of the position changing unit and the locking unit.
Figure 5B:
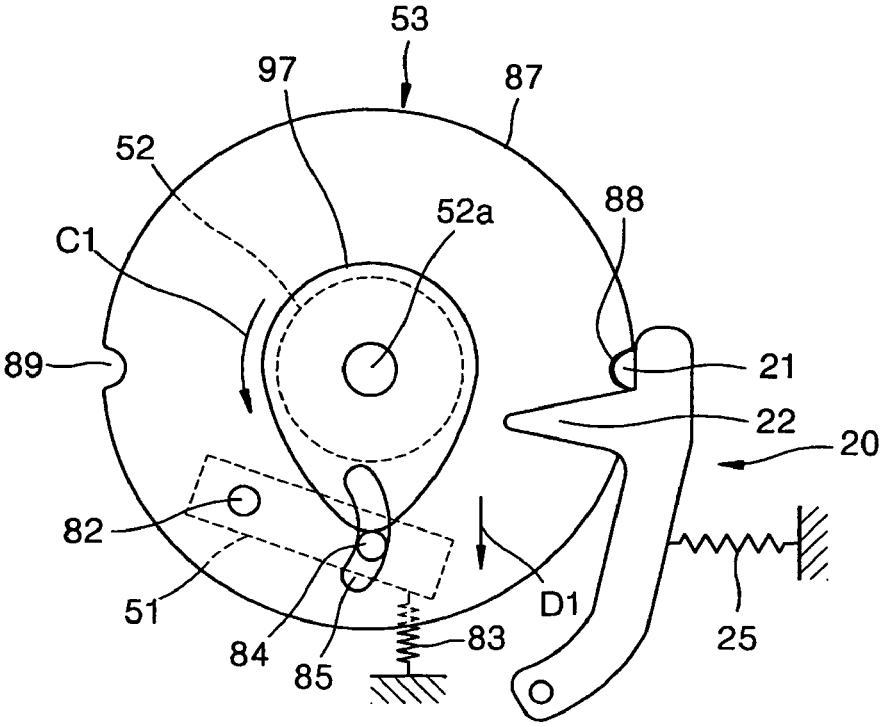
Figure 7A:
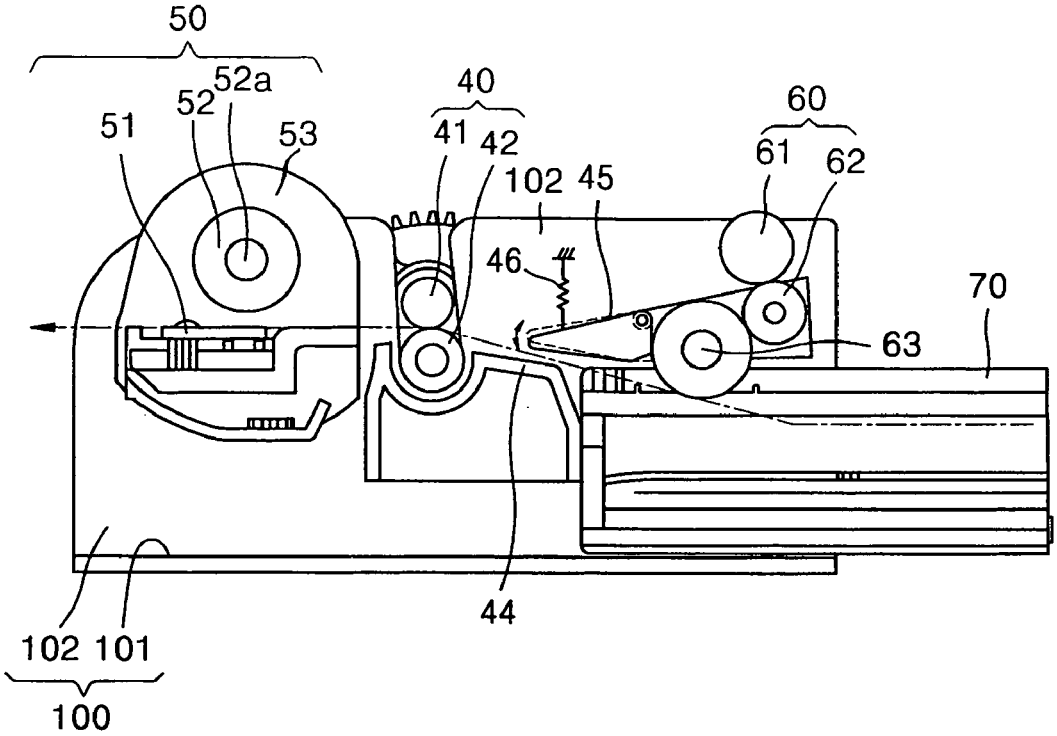
FIGS. 7A through 7H are views illustrating a printing method of an image forming apparatus according to an embodiment of the present invention.
Figure 7B:
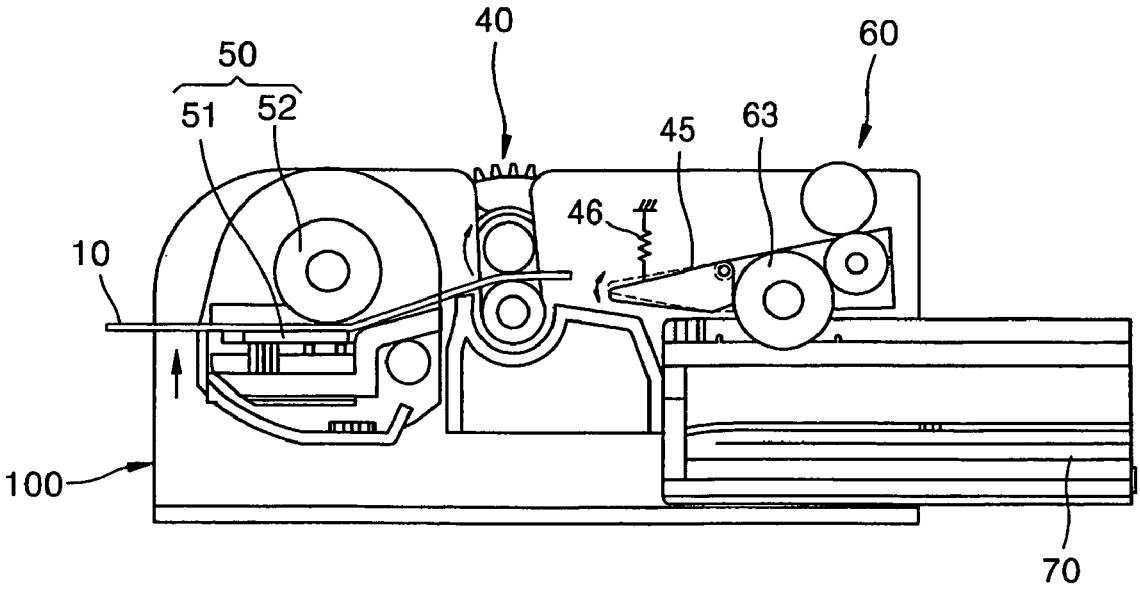

FIG. 7A illustrates a position of the thermal image forming apparatus when the recording medium 10 is picked up from the cassette 70 and the conveying part 40 moves the recording medium 10 toward the image forming part 50 positioned at the second path. FIG. 7B illustrates a position of the thermal image forming apparatus when the recording medium 10 is positioned at the print start location. As shown in FIG. 5A, at an initial position, the recording head 51 is brought into contact with the support member 52 by pressure. Also, the protrusion 21 of the locking member 20 is caught by the first locking groove 88, such that the recording head 51 is locked to the location "A" of FIG. 1. The recording medium 10 fed from a feed cassette 70 by the pickup roller 63 and is conveyed to the conveying part 40 through the first path. At this point, the recording medium 10 is guided toward the second path by the recording medium guide 45. Before the recording medium 10 is conveyed to the second path or before the recording medium 10 is picked up by the pickup roller 63, preferably the recording head 51 is separated from the support member 52. Referring to FIG. 5B, the rotation cam 95 rotates in a direction indicated by an arrow "C1" and the cam 97 pushes the push arm 84. The support bracket 53 does not rotate because the protrusion 21 of the locking member 20 is coupled to the first locking groove 88 of the support bracket. As the push arm 84 is pushed along the through hole 85 in a direction indicated by an arrow "D1", the recording head 51 rotates around the hinge hole 82, such that the recording head 51 is separated from the support member 52. In this position, the conveying part 40 conveys the recording medium 10 toward the second path. Since the recording head 51 is separated from the support member 52, the recording medium 10 enters between the recording head 51 and the support member 52 without any resistance, even when the support member 52 does not rotate.

When the recording medium 10 is conveyed to a predetermined print start location, the conveying part 40 stops conveying the recording medium 10. Although not shown, a sensor may be provided to detect a front end and/or a rear end of the recording medium 10 so as to detect the print start location. Since it is apparent to those skilled in the art that the sensor for detecting the print start location may be appropriately configured, its detailed description is omitted.

Figure 5C:
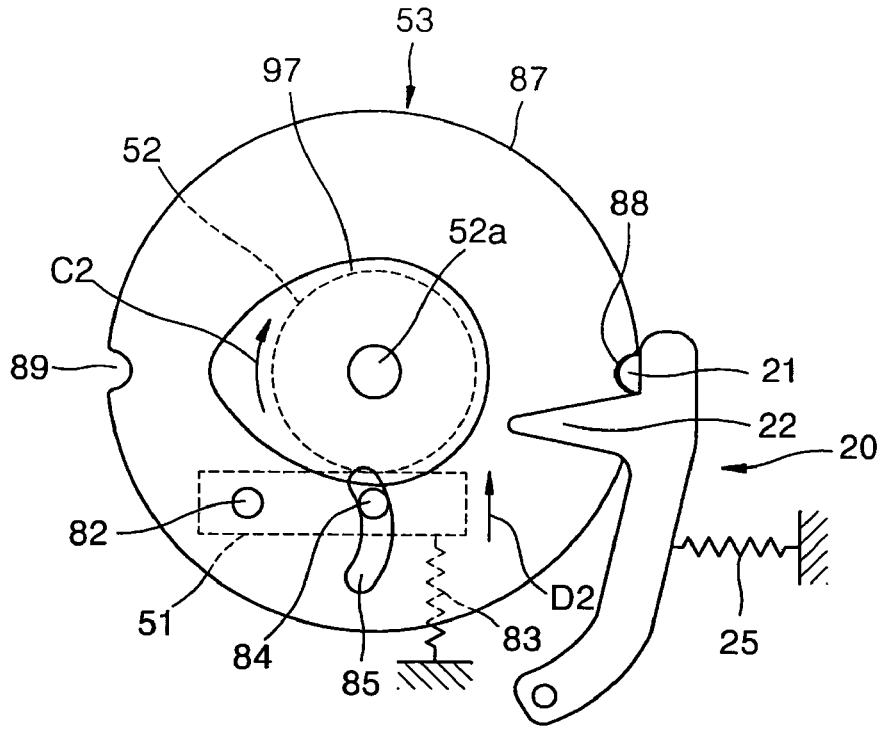
Figure 7C:
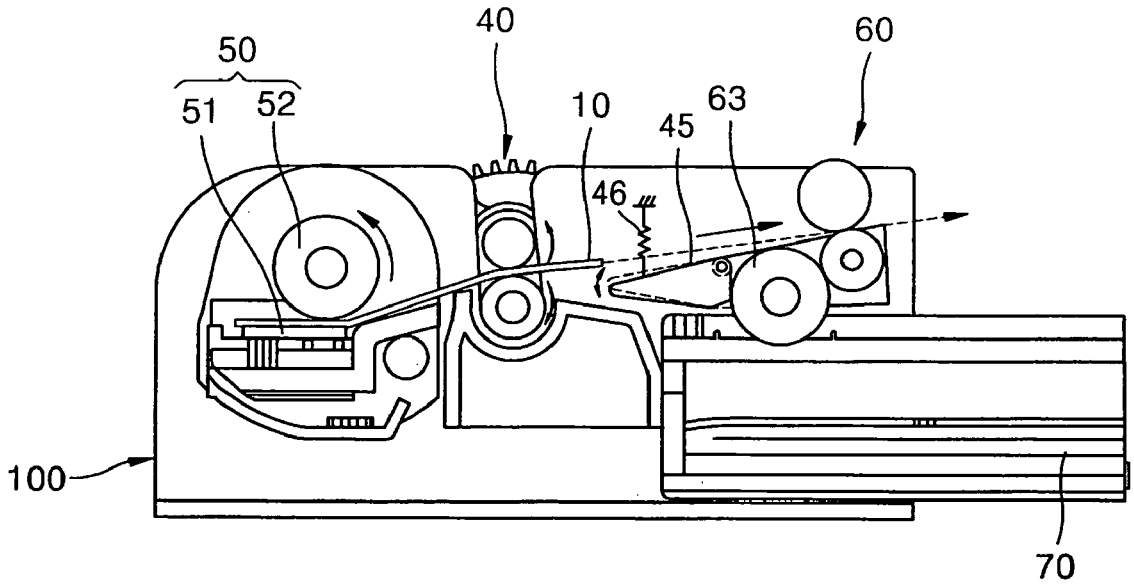

Referring to FIG. 7C, the recording head 51 must elastically contact the support member 52, with the recording medium 10 interposed therebetween. Referring to FIG. 5C, the rotation cam 95 rotates in a direction indicated by an arrow "C2". Since the protrusion 21 of the locking member 20 is coupled to the first locking groove 88, the support bracket 53 does not rotate. Due to the elastic force of the elastic member 83, the recording head 51 is rotated around the hinge hole 82 in a direction indicated by an arrow "D2", such that the recording head 51 elastically contacts the support member 52.

In this position, the conveying part 40 begins to convey the recording medium 10 toward the third path. The recoding head 51 prints magenta images, yellow images or the like by applying heat upon the first side of the recording medium 10. The magenta color and yellow color may be selectively reproduced depending on temperature and heating time of the recording medium 51. For example, the magenta color may be reproduced under conditions of a high temperature and a short time, and the yellow color may be reproduced under conditions of a low temperature and a relatively long time.

While the first side of the recording medium 10 is printing, the recording medium 10 is conveyed from the second path to the third path. At this point, the recording medium guide 45 is positioned at the fourth location by the elastic force of the elastic member 46 and guides the recording medium 10 toward the third path.

Figure 7D:
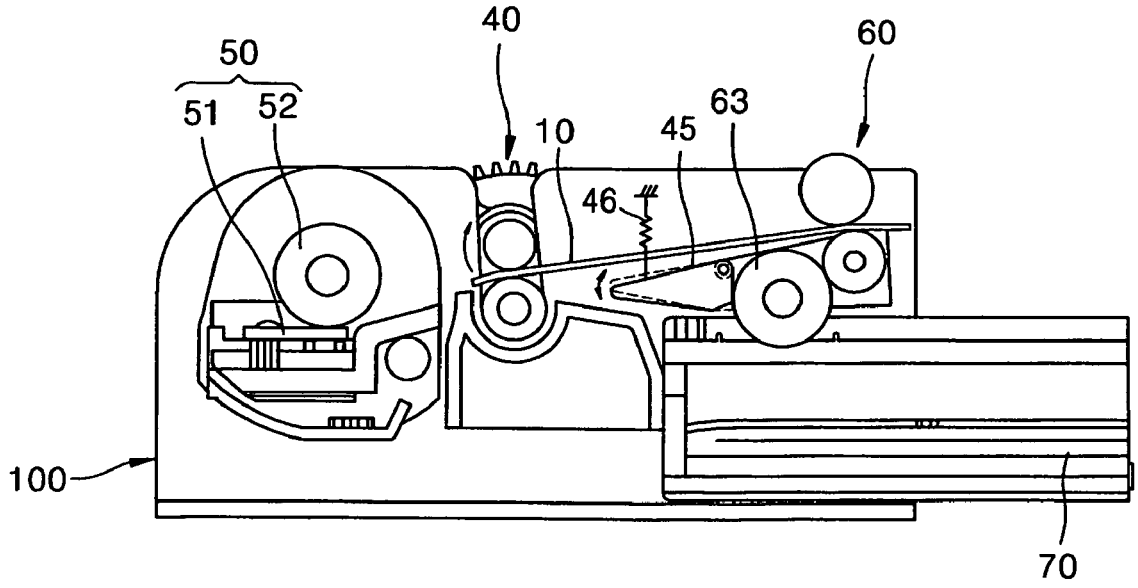

Referring to FIG. 7D, when the printing on the first side of the recording medium 10 is finished, the recording medium 10 has exited the second path and is positioned at the third path. The conveying part 40 stops conveying the recording medium 10. Both ends of the recording medium 10 are held by the conveying part 40 and the discharge part 60.

Figure 5D:
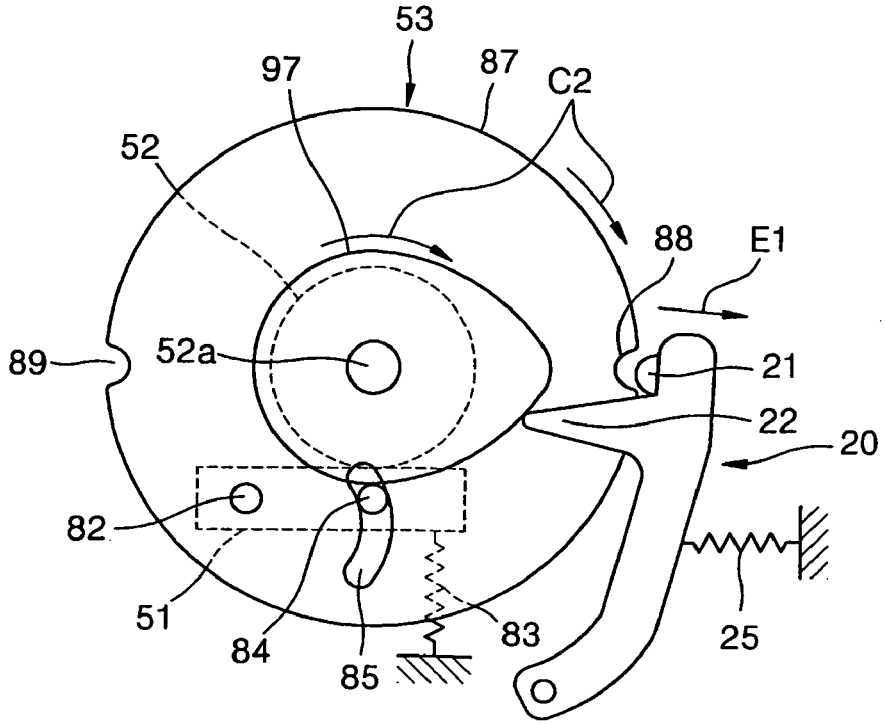
Figure 5E:
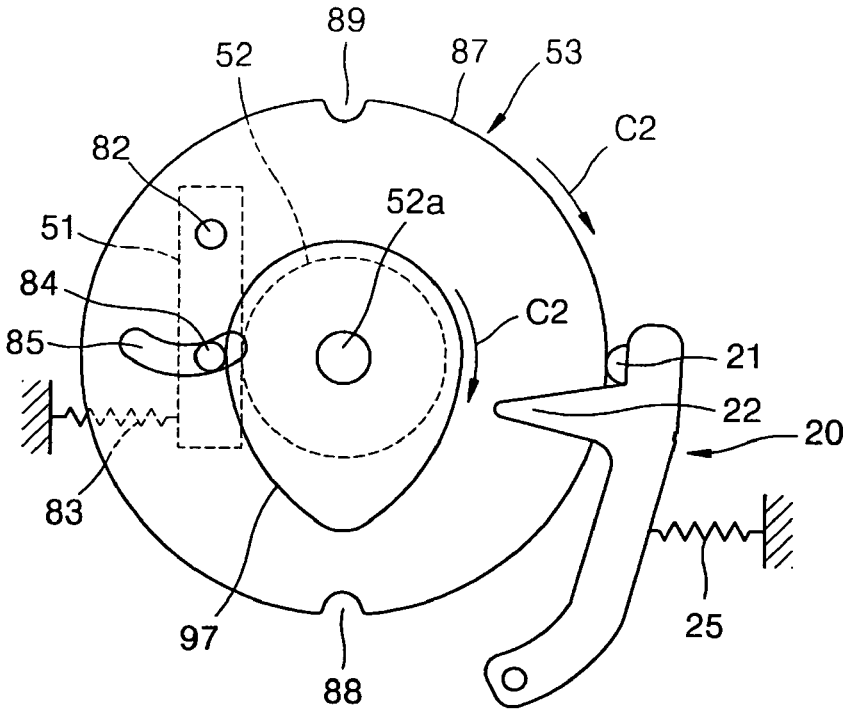

Then, an operation of rotating the recording head 10 toward the location "B" of FIG. 1 is performed to print an image on the second side of the recording medium 10. Referring to FIG. 5D, the rotation cam 95 rotates in a direction indicated by an arrow "C2". The cam 97 pushes the interference portion 22 such that the locking member 20 rotates in a direction indicated by an arrow "E1". The protrusion 21 is released from the first locking groove 88, and the support bracket 53 is set free such that it is freely rotatable. Accordingly, when the cam 97 continues to rotate in a direction indicated by the arrow "C2" the push arm 84 is pushed causing the support bracket 53 to rotate in a direction indicated by an arrow "C2" as shown in FIG. 5E. The recording head 51 moves in a direction indicated by the arrow "D1", thereby separating the recording head from the support member 52. While the support bracket 53 rotates in a direction indicated by an arrow "C2", the cam 97 pushes the push arm 84 such that the recording head 51 is substantially slightly separated from the support member 52. When the interference between the cam 97 and the interference portion 22 is finished, the locking member 20 is kept in contact with the outer circumference 87 of the support bracket 53 by the elastic force of the elastic member 25.

Figure 5F:
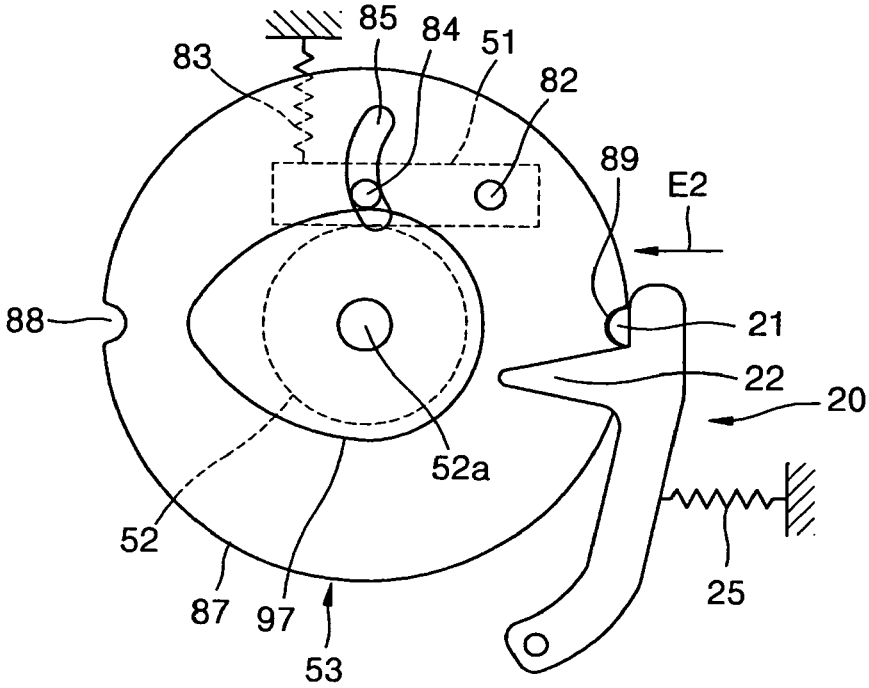
Figure 7E:
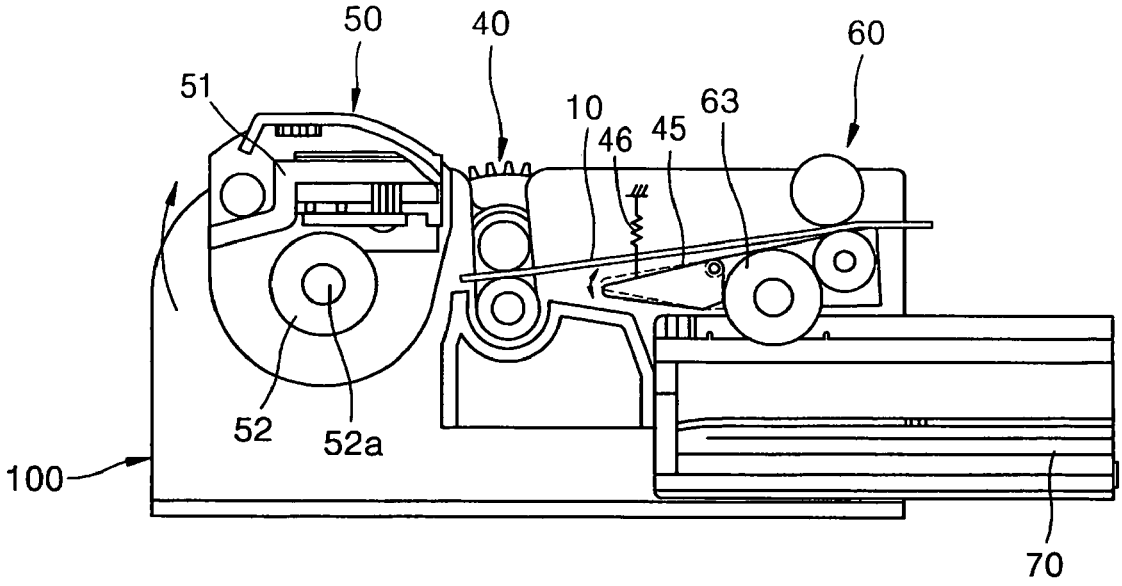

Referring to FIG. 5F, if the support bracket 53 rotates by 180° the elastic force of the elastic member 25 causes the locking member 20 to rotate in a direction indicated by an arrow "E2", such that the protrusion 21 is coupled to the second locking groove 89. Thus, the support bracket 53 is locked and prevented from further rotation. Referring to FIGS. 1 and 7E, the recording head reaches the location "B" facing the second side of the recording medium 10.

Figure 5G:
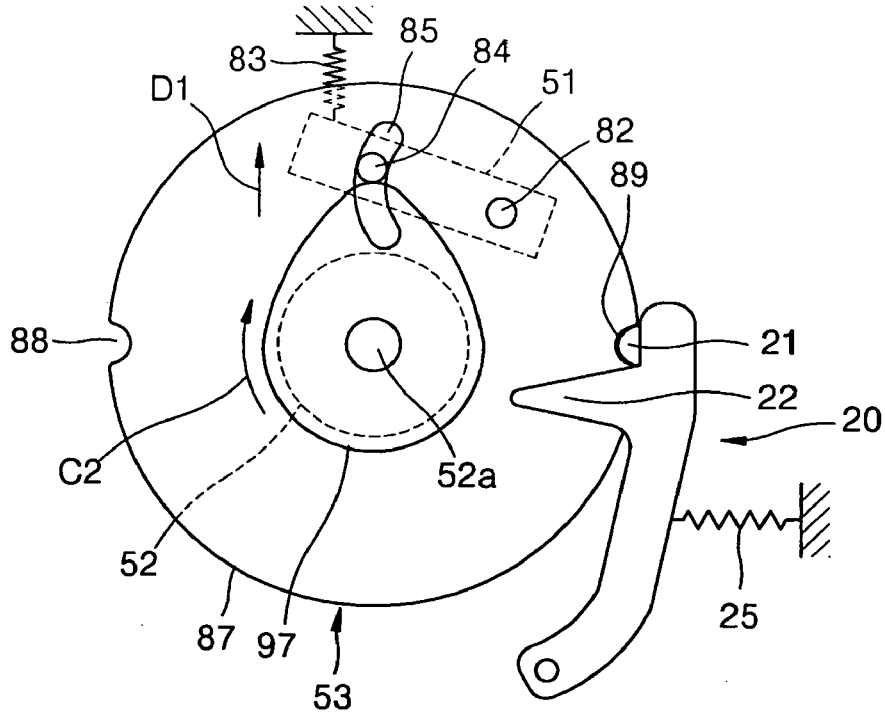

In order to set the print start location, the recording medium 10 must be conveyed from the third path to the second path. At this point, it is preferable that the recording head 51 and the support member 52 are separated from each other. In a position shown in FIG. 5F, if the rotation cam 95 continues to rotate in a direction indicated by the arrow "C2" (FIG. 5G), the support bracket 53 does not rotate because the protrusion 21 is coupled to the second locking groove 89. Referring to FIG. 5G, the push arm 84 is pushed along the through hole 85 and the recording head 51 is separated from the support member 52.

Figure 7F:
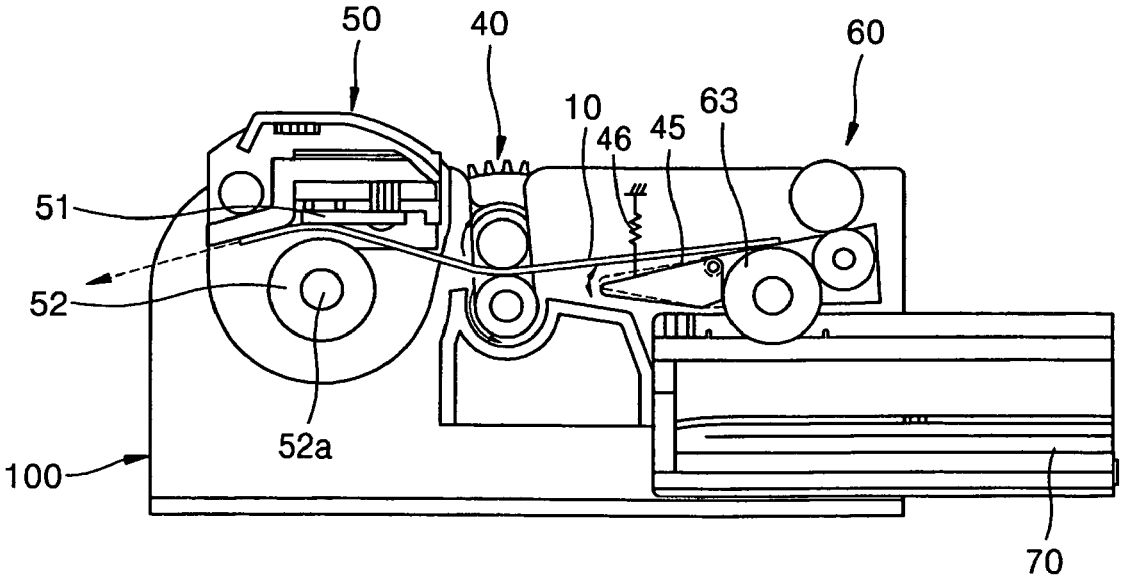
Figure 7G:
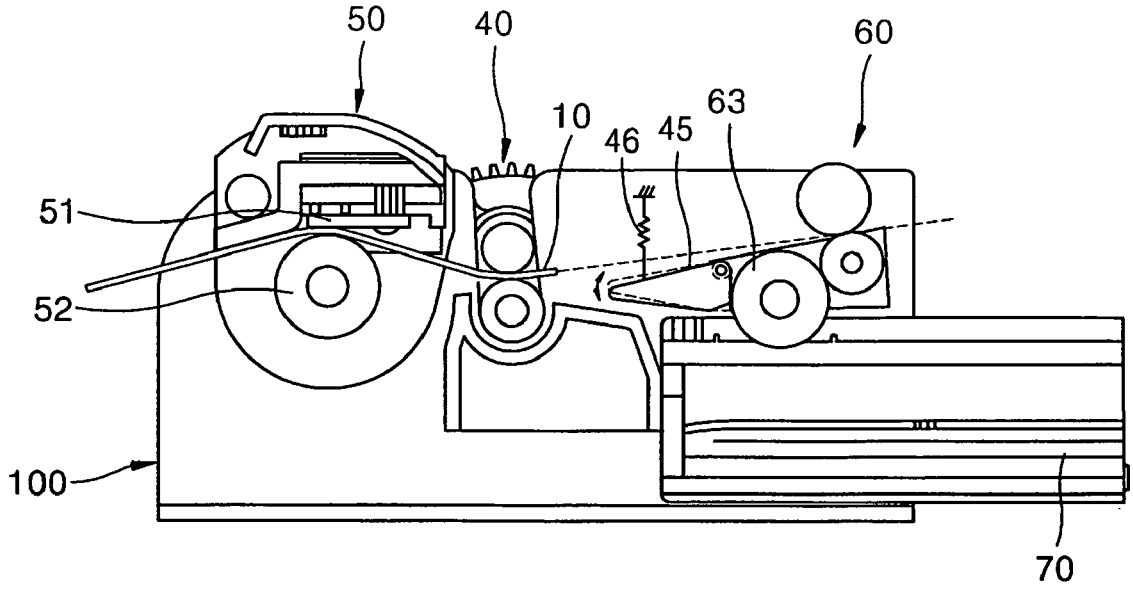

Referring to FIG. 7F, in this position the conveying part 40 conveys the recording medium 10 from the third path to the second path. When the recording medium 10 reaches the print start location, the conveying part 40 stops conveying the recording medium 10. In a position shown in FIG. 5G, if the rotation cam 95 rotates in the direction indicated by the arrow "C1", the support bracket 53 does not rotate because the protrusion 21 is coupled to the second locking groove 89. Instead, the push arm 84 moves backward along the through hole 85 as shown in FIG. 5H, and the recording head 51 comes into contact with the support member 52, with the recording medium 10 interposed therebetween, as shown in FIG. 7G.

Figure 7H:
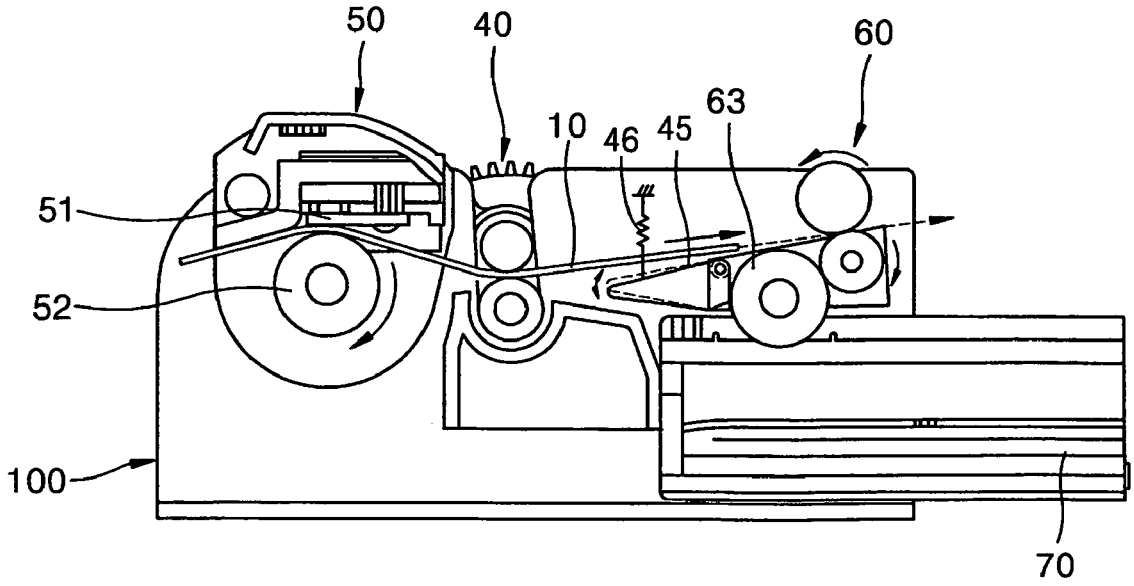

Referring to FIG. 7H, the conveying part 40 again conveys the recording medium 10 toward the third path. The recording head 51 prints cyan images on the second side of the recording medium 10 by applying heat thereto. After the printing on the first and second sides is finished, the recording medium 10 is discharged out of the image forming apparatus by the discharge part 60.

Figure 5H:
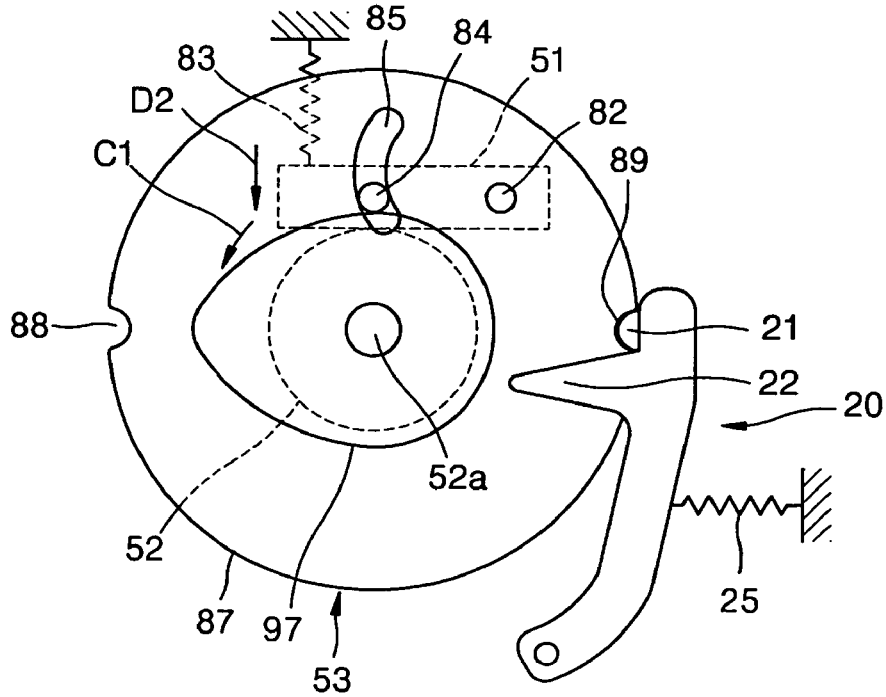
Figure 5I:
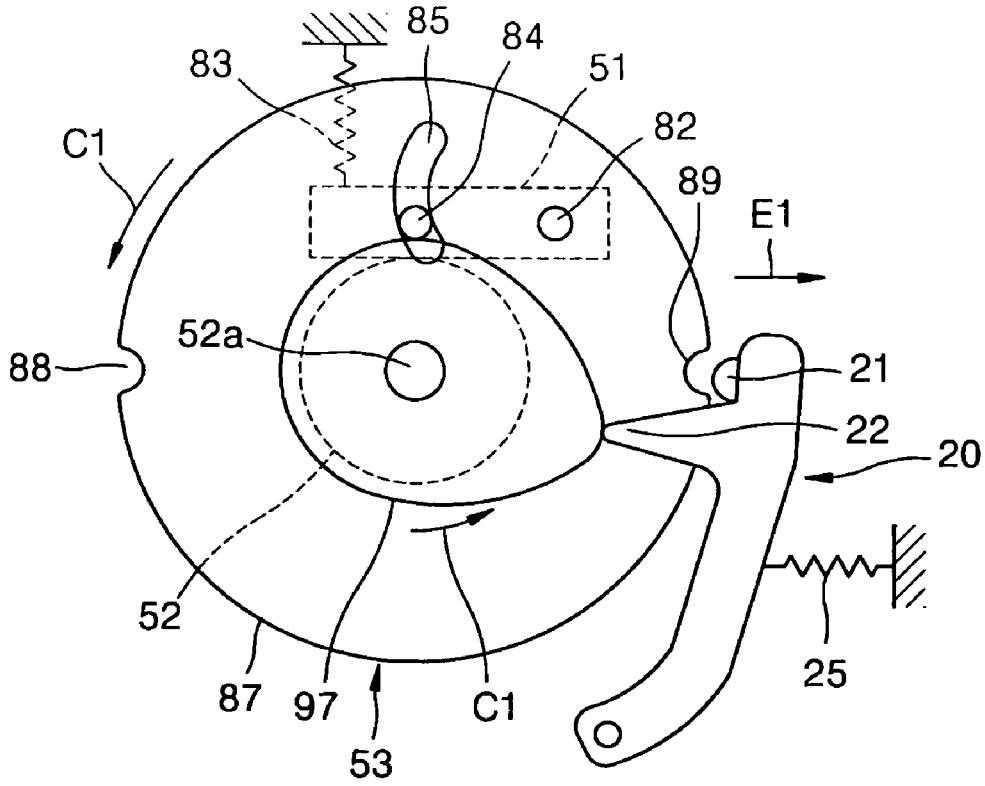

When the printing operation is completed, the rotation cam 95 rotates in a direction indicated by the arrow "C1" in the position shown in FIG. 5H. As shown in FIG. 5I, the cam 97 pushes the interference portion 22 such that the locking member 20 rotates in a direction indicated by the arrow "E1". In that case, the protrusion 21 is separated from the second locking groove 89 and the support bracket 53 is freely rotatable. The cam 97 pushes the push arm 84, the support bracket 53 rotates until the protrusion 21 is locked into the first locking groove 88 by the elastic force of the elastic member 25. As shown in FIG. 5A, the recording head 51 returns back to the location "A" of FIG. 1. In this position, as shown in FIG. 5A, the recording head 51 is ready for another printing operation.

The base sheet 11 of the recording medium 10 is formed of a transparent material. An opaque layer may be formed on one ink layer, for example the ink layer 12. Seen from the ink layer 13, cyan, magenta and yellow images are overlapped with one another, thereby representing full color images.

The thermal image forming apparatus according to the present invention may be used for a double-sided printing, that is, an image forming on both the first and second sides of the recording medium. If the base sheet 11 is formed of an opaque material, the double-sided printing is possible by forming different images on the first and second sides.

Although the embodiment in which the torque of the drive motor (not shown) is not transferred to the support member 52 is described above, the present invention is not so limited. If the torque of the drive motor is transferred to the support member 52, the recording head 51 and the support member 52 need not be separated from each other and the recording head 51 elastically maintains contact with the support member 52. The recording head 51 may be fixed to the support bracket 53, and the through hole 85 may have any shape that is adapted to receive the push arm 84. The push arm 84 may be formed on the support bracket 53. In this embodiment, there is no need to form the through hole 85. According to an embodiment of the present invention, the support bracket 53 is rotated due to the forward/reverse rotation of the rotation cam 95, such that the recording head 51 moves to the locations "A" and "B".

When color images are formed by printing different color images on both sides, the images printed on both sides must be accurately overlapped. This is called a "registration". If the registration is mismatched, a good print quality is not obtainable. According to the image forming apparatus disclosed in U.S. Pat. No. 6,296,405, the printings on the first and second sides of the recording medium are performed at different positions. Therefore, there is a strong possibility that the registration of the images printed on the first and second sides will be mismatched. Further, since the transfer errors of the recording medium and the recording head are overlapped, there is also a strong possibility that the registration will be mismatched.

In the image forming apparatus disclosed in U.S. Pat. No. 6,601,952, the recording head, the support member for pressure-contacting the recording medium with the recording head, and the holding member for holding the recording medium are configured with one rotation unit. The rotation of the rotation unit causes the recording head to face the first and second sides of the recording medium. Also, because the center of rotation is a contact point between the recording head and the support member, the position of the support member is changed. Also, due to the change in the position of the support member, it is difficult to transfer the torque of the drive motor to the support member.

According to an embodiment of the present invention, only the recording head 51 rotates around the shaft 52*a* of the support member 52 to form the images on both sides of the recording medium 10. The recording medium 10 is repeatedly conveyed two times through the straight path. Accordingly, since the recording medium 10 is conveyed along a very simple path while the images are printed on both sides, there is small possibility that a jam will occur of the recording medium 10. Also, since the recording head 51 rotates around the support member 52, the registration depends on the transfer precision of the conveying part 40. As a result, it is possible to obtain good print quality. Further, since the position of the support member 52 is not changed, it is easy to transfer the torque of the drive motor to the support member 52.

According to an embodiment of the present invention, it is possible to implement the thermal image forming apparatus capable of the double-sided printing with the stable rotation structure because the recording head rotates around the support member. Also, since the transfer path of the recording medium is very simple, the structure may also be simplified. Thus, it needs a small number of parts and its scale is very small. Compared with the conventional printers, mechanical troubles seldom occur in the image forming apparatus.

The thermal image forming apparatus has a simple and compact structure and it is adapted to a small-sized portable printer and a photograph printer requiring a more upgraded picture quality, especially a digital image printer corresponding to a digital camera.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A thermal image forming apparatus, comprising:

an image forming part having a recording head adapted to form an image on a recording medium, and a rotatable support member facing the recording head and supporting the recording medium with respect to the recording head, the recording medium having a first side and a second side opposite the first side; and a position changing unit adapted to rotate the recording head around a shaft of the support member to move the recording head to first and second locations respectively facing the first and second sides of the recording medium.

2. The apparatus of claim 1, wherein the position changing unit includes a support bracket supported rotatably around the shaft of the support member, the recording head being coupled to the support bracket; and a rotation cam adapted to rotate the support bracket to selectively face the recording head to the first and second sides of the recording medium.

3. The apparatus of claim 2, wherein a push arm has one end connected to the recording head and the other end inserted into a through hole formed in the support bracket, the rotation cam pushing the support bracket to be rotated.

4. The apparatus of claim 2, wherein a locking unit locks the recording head at the first and second locations.

5. The apparatus of claim 4, wherein the locking unit has first and second locking grooves formed at the support bracket, the first and second locking grooves corresponding to the first and second locations of the recording head;

a locking member selectively locked into the first and second locking grooves; and an elastic member elastically biasing the locking member toward the first and second locking grooves, the rotation cam releasing the locking member from the first and second locking grooves and rotating the support bracket.

6. The apparatus of claim 5, wherein the support bracket has a circular outer circumference, the first and second locking grooves are formed at the circular outer circumference, the locking member continuously contacts the outer circumference of the support bracket while the rotation cam rotates the support bracket, and the locking member is locked into the first or second locking groove due to an elastic force of the elastic member when the recording head is positioned at the first or second location.

7. The apparatus of claim 2, wherein an elastic member elastically biases the recording head toward the support member, and the recording head is rotatably installed in the support bracket in a direction that comes into contact with the support member or in a direction that is separated from the support member.

8. The apparatus of claim 5, wherein a push arm has one end coupled to the recording head and the other end inserted into a through hole formed at the support bracket, the through hole is formed in an arc shape centering on a rotational shaft of the recording head, and when the locking member is locked into the first or second locking groove, the rotation cam comes into contact with the push arm such that the recording head contacts or is separated from the support member, and when the locking member is unlocked from the first or second locking groove, the rotation cam pushes the push arm such that the support bracket rotates.

9. The apparatus of claim 1, wherein a conveying part to convey the recording medium in a first direction for forming an image or in a second direction for setting a start location, the support member is driven and rotated by contact with the recording medium while the recording medium is conveyed in the first direction.

10. The apparatus of claim 1, wherein a first path through which the recording media is initially fed;

a second path installed in the image forming part;

a third path branched from a connecting part of the first and second paths and through which a printed recording medium is discharged; and a conveying part installed in the connecting part to convey the recording medium in the first or second direction.

11. The apparatus of claim 10, wherein the recording medium is loaded into a feed cassette; and a pickup roller is adapted to pick up the recording medium from the feed cassette and transfer the recording medium to the conveying part through the first path.

12. The apparatus of claim 11, wherein a discharge part installed in the third path discharges the printed recording medium.

13. The apparatus of claim 12, wherein the discharge part includes a discharge roller and an idle roller engaged with the discharge roller, and the discharge roller rotates in contact with the pickup roller.

14. The apparatus of claim 10, wherein a recording medium guide rotates to a third location for guiding the recording medium from the first path to the second path, and to a fourth location for guiding the recording medium from the second path to the third path and from the third path to the second path.

15. The apparatus of claim 14, further comprising an elastic member adapted to apply an elastic force to the recording medium guide to rotate the recording medium guide to the fourth location, and the recording medium guide contacts the recording medium as the recording medium moves from the first path to the second path and is rotated toward the third location.

* * * * *